US009718208B2

(12) United States Patent
Takayanagi et al.

(10) Patent No.: US 9,718,208 B2
(45) Date of Patent: Aug. 1, 2017

(54) CHAIN TENSION ADJUSTING APPARATUS FOR CHAIN SAW

(71) Applicant: MAKITA CORPORATION, Aichi (JP)

(72) Inventors: Yoshiaki Takayanagi, Tokyo (JP); Masashi Sugiyama, Tokyo (JP)

(73) Assignee: MAKITA CORPORATION, Aichi (JP)

( * ) Notice: Subject to any disclaimer, the term of this patent is extended or adjusted under 35 U.S.C. 154(b) by 182 days.

(21) Appl. No.: 14/220,283

(22) Filed: Mar. 20, 2014

(65) Prior Publication Data

US 2014/0290076 A1 Oct. 2, 2014

(30) Foreign Application Priority Data

Mar. 29, 2013 (JP) ..... 2013-074905

(51) Int. Cl.
*B27B 17/14* (2006.01)

(52) U.S. Cl.
CPC ..... *B27B 17/14* (2013.01)

(58) Field of Classification Search
CPC ..... B27B 17/14
USPC ..... 30/381–387
See application file for complete search history.

(56) References Cited

U.S. PATENT DOCUMENTS 3,636,995 A * 1/1972 Newman ..... B27B 17/14 30/386
4,920,650 A 5/1990 Edlund
5,528,835 A * 6/1996 Ra ..... B27B 17/14 30/383
6,209,412 B1 * 4/2001 Hiratsuna ..... F02B 63/02 123/398
6,782,627 B2 * 8/2004 Hermes ..... B27B 17/14 30/386
7,600,323 B2 * 10/2009 Sugishita ..... B27B 17/14 30/386

(Continued)

FOREIGN PATENT DOCUMENTS

CN EP 3130433 A1 * 2/2017 ..... B27B 17/14
DE 3906510 9/1989

(Continued)

OTHER PUBLICATIONS

German Official Action for DE Appl. No. 102014004061.5 dated Nov. 18, 2014, along with an English-language translation thereof.

(Continued)

*Primary Examiner* — Jason Daniel Prone
(74) *Attorney, Agent, or Firm* — Greenblum & Bernstein, P.L.C.

(57) ABSTRACT

In a chain saw, an operating shaft member axially rotated by a manual operation of a rotating lever is disposed so that an axial direction thereof may be inclined against an attaching surface of a guide bar in which a saw chain is wound around a circumference thereof, a driving bevel gear attached to an end portion of the operating shaft member meshes with a driven bevel gear attached to an end portion of a rotating shaft member, and the rotating shaft member is axially rotated. Thus, the guide bar is moved in a longitudinal direction thereof to adjust tension of the saw chain.

9 Claims, 8 Drawing Sheets

(56) References Cited

U.S. PATENT DOCUMENTS

| | | | | |
|---|---|---|---|---|
| 8,220,166 | B2 * | 7/2012 | Fisher | B27B 17/14 30/383 |
| 8,365,420 | B2 * | 2/2013 | Pellenc | B27B 17/14 30/386 |
| 8,434,236 | B2 * | 5/2013 | Pellenc | B27B 17/14 30/386 |
| 8,495,819 | B2 * | 7/2013 | Okouchi | B27B 17/14 30/386 |
| 2009/0124398 | A1 * | 5/2009 | Thompson | A61B 1/0052 464/52 |
| 2009/0241353 | A1 * | 10/2009 | Ericson | B27B 17/14 30/386 |
| 2010/0293797 | A1 | 11/2010 | Fisher et al. | |
| 2011/0308096 | A1 * | 12/2011 | Yu | B27B 17/14 30/386 |
| 2013/0086810 | A1 * | 4/2013 | Peterson | B27B 17/14 30/386 |
| 2014/0150271 | A1 | 6/2014 | Yamaoka et al. | |
| 2014/0250702 | A1 * | 9/2014 | Zimmermann | B27B 17/14 30/386 |
| 2014/0290074 | A1 * | 10/2014 | Takayanagi | B23D 57/023 30/382 |
| 2014/0290075 | A1 * | 10/2014 | Takayanagi | B27B 17/14 30/386 |
| 2015/0135542 | A1 * | 5/2015 | Cook | B27B 17/14 30/386 |
| 2017/0043421 | A1 * | 2/2017 | Nie | B23D 57/023 30/386 |

FOREIGN PATENT DOCUMENTS

| | | | | |
|---|---|---|---|---|
| DE | 9105363 | | 8/1991 | |
| DE | 19931249 | A1 * | 1/2001 | |
| DE | 202013104098 | | 2/2014 | |
| JP | 58-028050 | | 2/1983 | |
| JP | 10-286802 | | 10/1998 | |
| JP | 2006-238876 | | 9/2006 | |
| JP | DE 102014004061 | A1 * | 10/2014 | B27B 17/14 |
| JP | DE 102014004062 | A1 * | 7/2015 | B27B 17/14 |
| WO | 89/01101 | | 2/1989 | |

OTHER PUBLICATIONS

Japanese Office Action for JP App. No. 2013-074905 mailed on Jul. 5, 2016, along with an English-language translation thereof.

German Official Action with English translation for DE 10 2014 004 061.5, having a mailing date of Mar. 9, 2017.

Japanese Office Action for JP App. No. 2013-074905 mailed Jan. 17, 2017, along with English-language translation thereof.

* cited by examiner

CHAIN TENSION ADJUSTING APPARATUS FOR CHAIN SAW

BACKGROUND OF THE INVENTION

1. Field of the Invention

The present invention relates to an apparatus for adjusting tension of a saw chain wound and traveling around a guide bar of a chain saw.

2. Description of Related Art

In a chain saw, tension of a saw chain (hereinafter referred to as a chain) is adjusted by moving a guide bar in a longitudinal direction thereof against a sprocket that drives the chain to adjust a mutual distance.

As a chain tension adjusting apparatus of this kind, there is one that adjusts tension of the chain by moving the guide bar by a manual operation without using a tool.

Japanese Laid-open (Kokai) Patent Application Publication No. 2006-238876 discloses a chain tension adjusting apparatus described below. A slide nut attached to a guide bar is screwed with a screw member, and an adjusting wheel fixed to a rotating shaft of a gear meshing with a gear attached to an end portion of the screw member is rotated manually. Thus, the screw member is rotated, and the guide bar moves in an axial direction of the screw member integrally with the slide nut, to thereby adjust tension of a chain.

However, as described in Japanese Laid-open (Kokai) Patent Application Publication No. 2006-238876, in a case in which a rotating shaft of the adjusting wheel is disposed in parallel with the screw member, the adjusting wheel needs to be disposed outside an outside diameter of a nut member for fastening of the guide bar. Furthermore, when a radius of the adjusting wheel is enlarged for reducing an operating force, a space in which the adjusting wheel is disposed laterally from an attaching surface of the guide bar is enlarged to prevent interference with a traveling path of the saw chain in a chain saw main body, and thus, a width of the chain saw increases.

There is an apparatus in which an operating portion for chain tension adjustment is disposed at a part significantly away from a fastening portion of the guide bar to prevent interference with the traveling path of the saw chain and the like. However, such an apparatus has a complicated mechanism such as an increase in the number of gears for transmission of the operating force and cannot be reduced in size.

SUMMARY OF THE INVENTION

The present invention is accomplished by taking such conventional problems as mentioned above into consideration, and an object of the present invention is to provide a chain tension adjusting apparatus for a chain saw that is compact in size and enables reduction in the number of parts.

In order to achieve the above object, in a chain tension adjusting apparatus for a chain saw according to the present invention, a guide bar in which a saw chain driven by a sprocket is wound around a circumference thereof is moved in a longitudinal direction thereof to adjust tension of the saw chain, and an operating shaft member that is axially rotated by a manual operation to move the guide bar via a bevel gear mechanism is disposed so that an axial direction thereof may be inclined against an attaching surface of the guide bar.

According to the present invention, by disposing a shaft of the operating shaft member in an inclined manner against the attaching surface of the guide bar, a space between the operating shaft member and the guide bar attaching surface can be expanded further at a closer position to an operating portion of the operating shaft member. Thus, interference of the operating shaft member with a traveling path of the chain and dirt adhering to the chain can be prevented, and dirt can be discharged smoothly.

Furthermore, a guide bar moving mechanism such as screw members can be driven directly by the operating shaft member, which enables the number of parts to be restricted to a minimum, enables the apparatus to be disposed in a compact manner, and facilitates reducing the size of the chain saw.

Other objects and features of aspects of the present invention will be understood from the following description with reference to the accompanying drawings.

DESCRIPTION OF THE PREFERRED EMBODIMENTS

Hereinbelow, embodiments of the present invention will be described with reference to the drawings.

Figure 1:
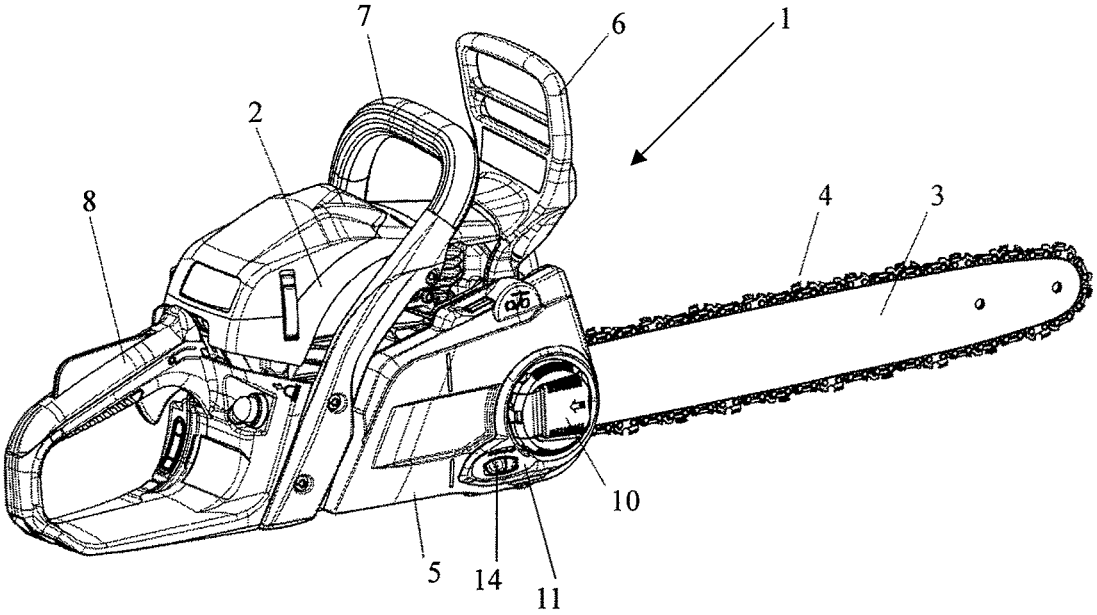
FIG. 1 is a perspective view illustrating an overall configuration of a chain saw according to an embodiment of the present invention.

FIG. 1 illustrates an overall configuration of a chain saw according to an embodiment of the present invention, and FIGS. 2 to 9 illustrate configurations of respective parts.

A chain saw 1 has a guide bar 3 extending forward attached to a chain saw main body (hereinafter simply referred to as a main body) 2. In the guide bar 3, a saw chain 4 is wound around a circumferential edge thereof.

The saw chain 4 is adapted to travel around the circumferential edge of the guide bar 3 through engagement with a sprocket (not shown) which is rotary-driven by an engine, an electric motor, or the like in the main body 2.

A peripheral part in which an end portion of the guide bar 3 and the sprocket adjacent to the end portion of the guide bar 3 and engaged with the saw chain 4 to rotary-drive, are provided, is covered with a chain cover 5, and the chain cover 5 is attached to the main body 2.

To a front portion of the main body 2 is attached a front guard 6 that is integral with the chain cover 5, and on a back side of the front guard 6 are attached a front handle 7 and a rear handle 8.

Figure 2:
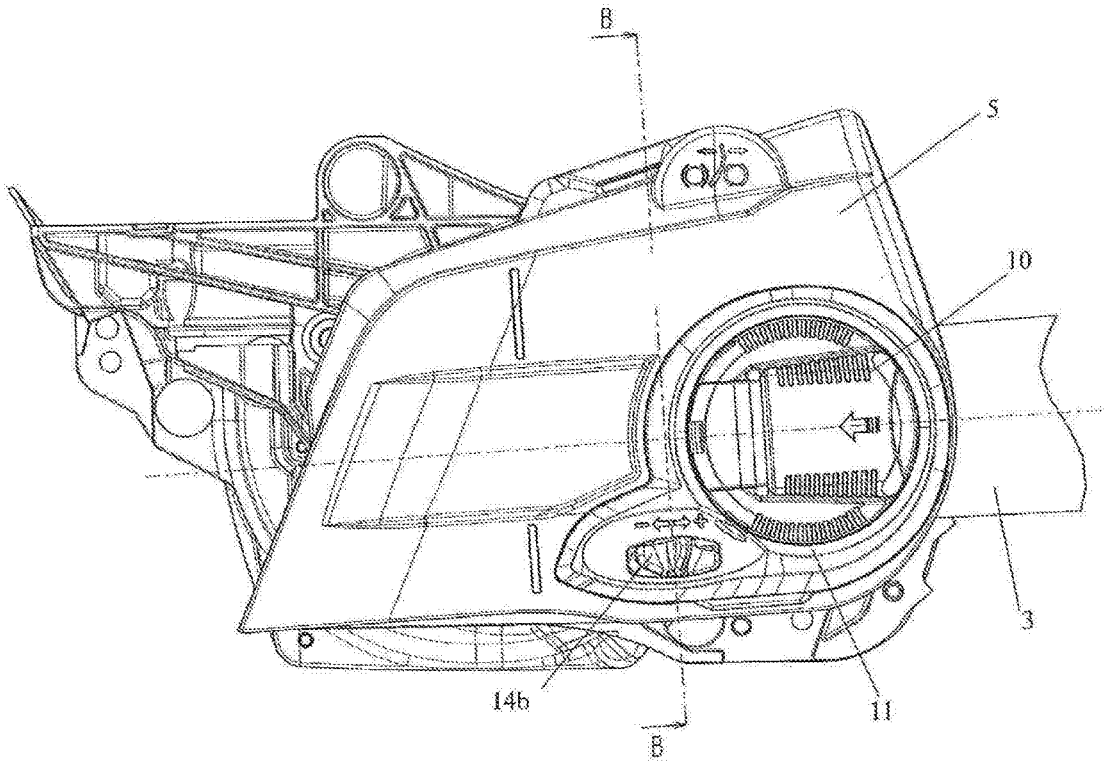
FIG. 2 is a front view of a main part of the chain saw.
Figure 3:
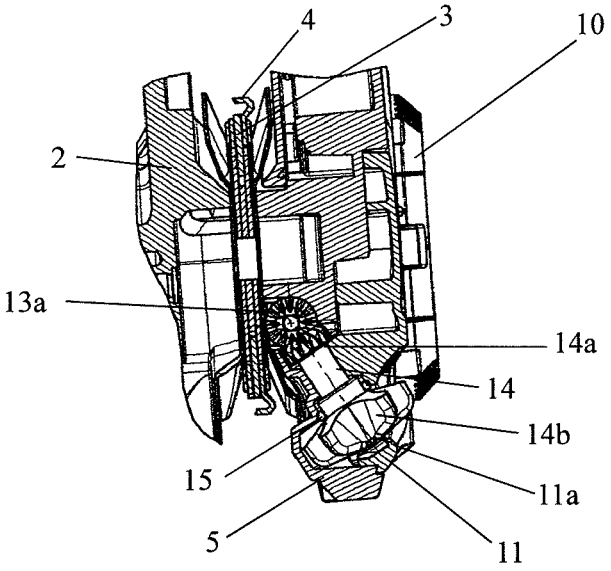
FIG. 3 is a cross-sectional view viewed from the arrow direction of the line B-B of FIG. 2.
Figure 4:
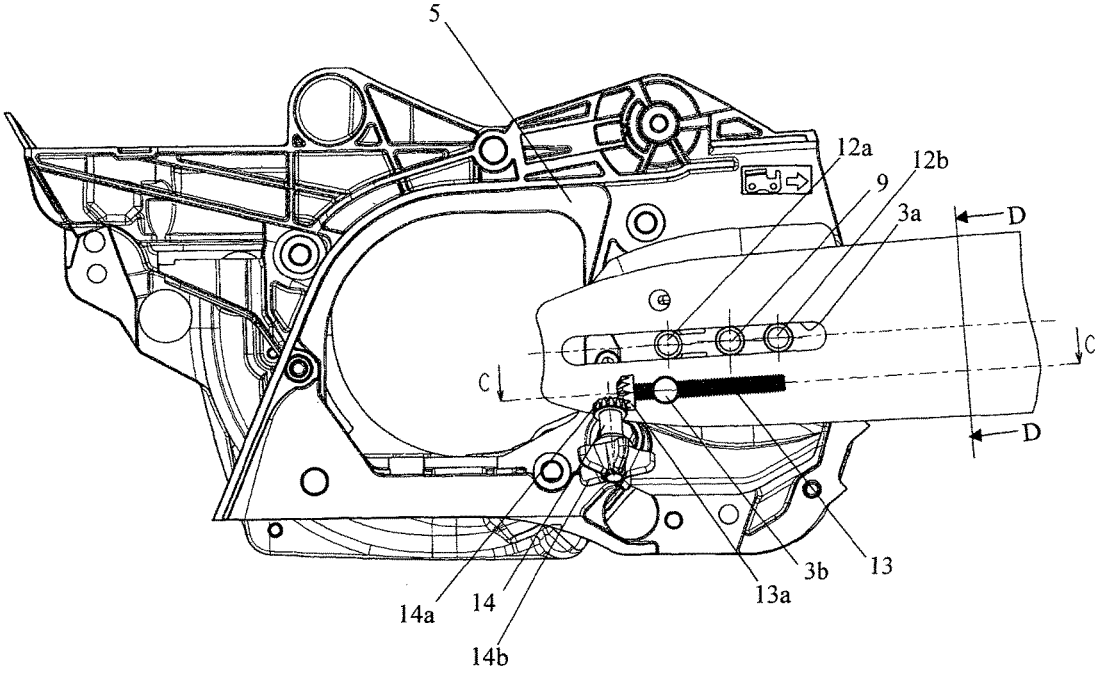
FIG. 4 is a vertical cross-sectional view of the main part of the chain saw.

As illustrated in FIGS. 2 to 4, as for the guide bar 3, one end portion thereof on a side adjacent to the sprocket is sandwiched between the main body 2 and the chain cover 5 and fastened by fastening a nut member 10 to a stud bolt 9 passing through an after-mentioned elongated hole 3*a* of the guide bar 3 and fixed to the main body 2.

Figure 7:
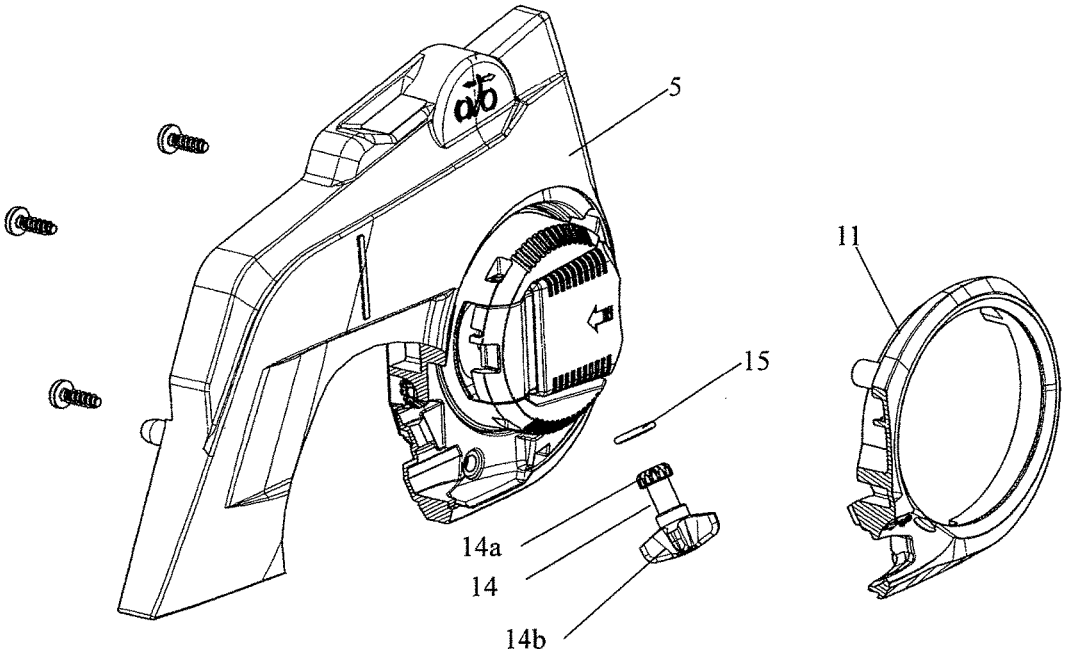
FIG. 7 is an exploded perspective view of the main part of the chain saw from one direction.
Figure 8:
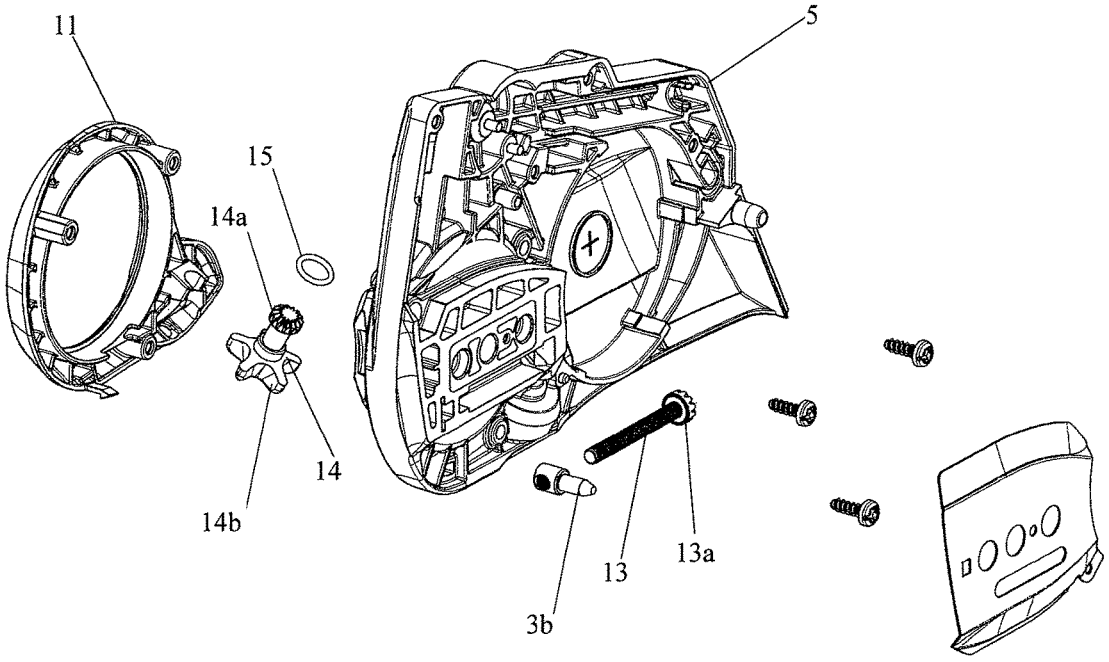
FIG. 8 is an exploded perspective view of the main part from an opposite direction of the direction in FIG. 7.
Figure 9:
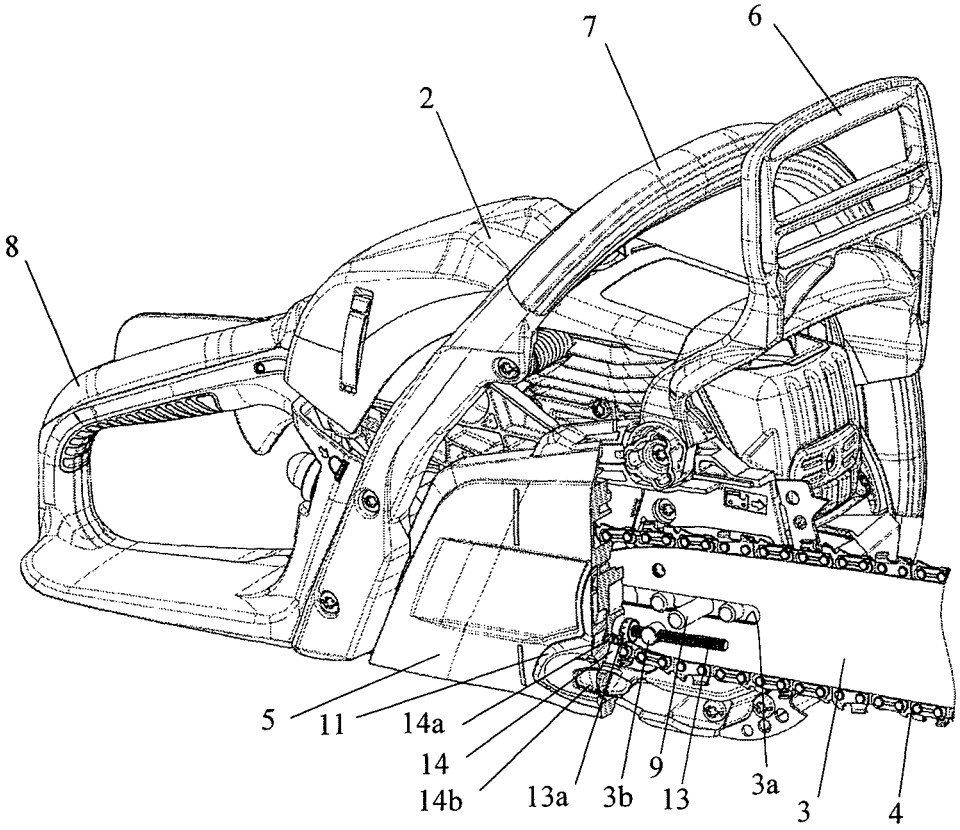
FIG. 9 is a cross-sectional perspective view of the main part of the chain saw.

As illustrated in FIGS. 7 and 8, in the chain cover 5, an operating portion cover 11 is screwed and mounted. The operating portion cover 11 exposes a fastening mechanism of the guide bar 3 by the nut member 10 and an operating portion of an after-mentioned tension adjusting mechanism of the saw chain 4 and covers an internal mechanism.

A mechanism for adjusting tension of the saw chain 4 by adjustment of a moving amount of the guide bar 3 in a longitudinal direction is configured as below.

As illustrated in FIG. 4, in the guide bar 3, the elongated hole 3*a* that guides movement in the longitudinal direction on a center axis in the longitudinal direction, is formed, and a pair of guide pins 12*a* and 12*b* fixed on both sides of the stud bolt 9 of the main body 2 is fitted and inserted into the elongated hole 3*a*, to guide movement of the guide bar 3 in the longitudinal direction.

Figure 5:
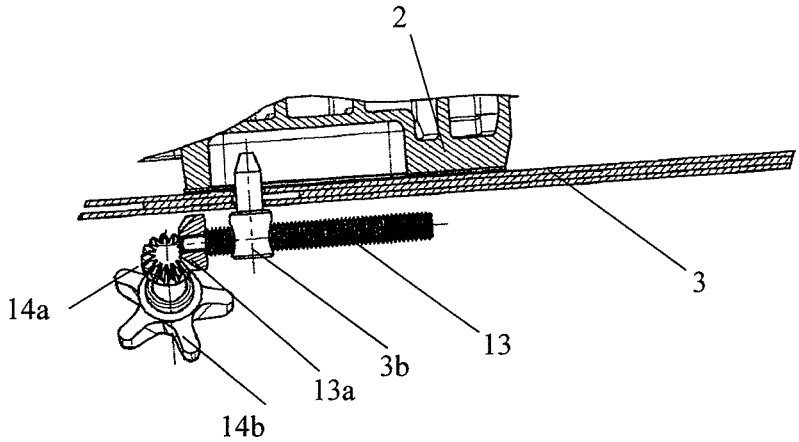
FIG. 5 is a cross-sectional view viewed from the arrow direction of the line C-C of FIG. 4.
Figure 6:
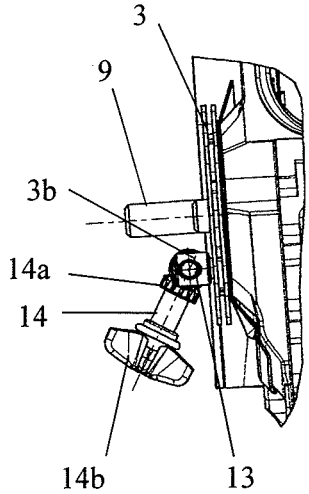
FIG. 6 is a cross-sectional view viewed from the arrow direction of the line D-D of FIG. 4.

As illustrated in FIGS. 4 to 6, a slide nut 3*b* is attached to the guide bar 3 on a lower side of the elongated hole 3*a* to pass therethrough, and a cylindrical portion of the slide nut 3*b* projecting to a side of the chain cover 5 is provided with a female screw in a direction perpendicular to an axial direction thereof and parallel to the center axis of the guide bar 3.

Into the female screw of the slide nut 3*b*, a screw formed on a rotating shaft member 13 is screwed. To one end portion of the rotating shaft member 13 on a side of the sprocket, a driven bevel gear 13*a* is attached. The driven bevel gear 13*a* meshes with below-mentioned driving bevel gear, which causes movement of the rotating shaft member 13 to the side of the sprocket to be restricted. On the other hand, as for the other end portion of the rotating shaft member 13, movement thereof to an opposite side of the sprocket side is restricted by a stopper (not shown) formed on the chain cover 5.

In this manner, movement of the rotating shaft member 13 in an axial direction is restricted. Thus, when the rotating shaft member 13 is rotated axially, the slide nut 3*b* moves in the axial direction of the rotating shaft member 13, and the guide bar 3 moves in the longitudinal direction integrally with the slide nut 3*b*.

Furthermore, an operating shaft member 14 that axially rotates the rotating shaft member 13 by a manual operation is disposed in the following manner.

To one end portion of the operating shaft member 14, a driving bevel gear 14*a* that meshes with the driven bevel gear 13*a* of the rotating shaft member 13 is attached, and to the other end portion, a rotating lever 14*b* for the manual operation is connected. The rotating lever 14*b* is formed in a star shape having a plurality of protrusions axially at regular intervals. It is to be noted that the shape is not limited to the star shape but may be any shape as long as it has a non-slip function in an axial rotating direction.

The operating shaft member 14 is disposed so that an axial direction thereof may be inclined against an attaching surface of the guide bar 3. The operating shaft member 14 is disposed so that the axial direction of the operating shaft member 14 may be in a direction perpendicular to the axial direction of the rotating shaft member 13.

That is, as illustrated in FIG. 3 and the like, the operating shaft member 14 is sandwiched and positioned between the chain cover 5 and the operating portion cover 11, and a part of the rotating lever 14*b* is exposed outward from a window 11*a* opened on the operating portion cover 11. In this manner, the rotating lever 14*b* is arranged further on a side of the sprocket than a center of fastening of the guide bar 3 by the nut member 10 and on a lower side of the center.

Furthermore, into a shaft portion of the rotating lever 14*b*, an O-ring 15 is fitted and inserted to be attached in a state in which the O-ring 15 is compressed in a radial direction between the chain cover 5 and the operating portion cover 11.

In a case in which tension of the chain is adjusted by the tension adjusting mechanism configured as above, the nut member 10 is first rotated in a counterclockwise direction to loosen fastening of the guide bar 3 to allow movement of the guide bar 3 in the longitudinal direction.

Subsequently, when the rotating lever 14*b* is operated with a thumb to be rotated in one direction (for example, a clockwise direction), the driving bevel gear 14*a* is rotated in an equal direction (a clockwise direction), and the rotating shaft member 13 is also rotated axially in the equal direction (clockwise direction) integrally with the driven bevel gear 13*a* that meshes with the driving bevel gear 14*a*.

Accordingly, in a case in which the screw formed on the rotating shaft member 13 is a right screw, the guide bar 3 moves in a direction of approaching the sprocket integrally with the slide nut 3*b* screwed with the right screw, and tension of the saw chain 4 is reduced.

Furthermore, when the rotating lever 14*b* is rotated in a reverse direction (counterclockwise direction), the rotating shaft member 13 is rotated axially in an equal direction (counterclockwise direction) integrally with the driven bevel gear 13*a*, the guide bar 3 moves in a direction of separating from the sprocket integrally with the slide nut 3*b*, and tension of the saw chain 4 is increased.

In a case in which a left screw is formed on the rotating shaft member 13, the guide bar 3 moves in the direction of separating from the sprocket to increase tension of the saw chain 4 when the rotating lever 14*b* is rotated in the clockwise direction, while the guide bar 3 moves in the direction of approaching the sprocket to reduce tension of the saw chain 4 when the rotating lever 14*b* is rotated in the counterclockwise direction.

Accordingly, by rotating the rotating lever 14*b* in a direction of correcting current tension of the saw chain 4 as much as a predetermined amount, the tension of the saw chain 4 can be adjusted to an appropriate amount.

After adjusting the tension of the chain in this manner, the nut member 10 is rotated in a fastening direction (clockwise direction) to fasten the guide bar 3.

With the chain tension adjusting apparatus configured as above, the following effects can be obtained.

By disposing the shaft of the operating shaft member 14 in an inclined manner against the attaching surface of the guide bar 3, a space between the operating shaft member 14 and the guide bar 3 is expanded downward. Thus, as is apparent in FIG. 9 and the like, interference of the operating shaft member 14 with a traveling path of the saw chain 4 can be prevented, and the saw chain 4 can travel without difficulty. Furthermore, contact of the operating shaft member 14 with dirt attaching to the saw chain 4 to cause clogging is restricted, and dirt can be discharged smoothly.

Furthermore, while the interference with the traveling path of the saw chain 4 is prevented as mentioned above, the operating shaft member 14 can be disposed in a compact manner.

That is, in terms of a longitudinal direction of the chain saw 1, the rotating shaft of the operating shaft member 14 is disposed in proximity to an attaching position of the driven bevel gear 13*a*, and a part of the rotating lever 14*b* is disposed to be overlapped inside an outside diameter of the nut member 10. Thus, a disposing space in the longitudinal direction can be reduced as much as possible.

On the other hand, in terms of a width direction perpendicular to the longitudinal direction of the chain saw, by disposing the operating shaft member 14 in an inclined manner, a disposing length of the chain saw in the width direction can be reduced significantly against an entire length of the operating shaft member 14.

Furthermore, in terms of an up-down direction of the chain saw, a lower end position of the rotating lever 14*b* is located in an approximately equal or slightly lower level to or than a lower end portion of the nut member 10 and can be located sufficiently further to an upper side than a lower end of the main body 2.

In this manner, with the tension adjusting apparatus according to the present embodiment, a disposing space in the respective three-dimensional directions of the chain saw can be reduced as much as possible to enable the apparatus to be disposed in a compact manner, which facilitates downsizing of the chain saw.

Furthermore, along with reduction of the disposing space as described above, only the operating shaft member 14 is required as a part that rotates the rotating shaft member 13, which enables the apparatus to be configured at low cost.

As a result of enabling reduction of the disposing space in the width direction of the chain saw as described above, as illustrated in FIG. 3, a projecting amount of the rotating lever 14*b* from the window 11*a* of the operating portion cover 11 can be smaller than a projecting amount of the nut member 10 even when the diameter of the rotating lever 14*b* is enlarged for reducing an operating force.

Therefore, the rotating lever 14*b* is less likely to get stuck with an external obstacle such as a tree branch, which improves workability of the chain saw.

Furthermore, by disposing the rotating lever 14*b* at a lower portion of the operating portion cover 11, a user can easily operate the rotating lever 14*b* only with a user's thumb, putting the user's hand on a bottom of the main body 2. Thus, the chain saw is excellent in operability as well.

Furthermore, in the present embodiment, since the O-ring 15 is fitted and inserted into the operating shaft member 14 to provide rotational resistance, movement of the operating shaft member 14 caused by backlash of a meshing portion of the bevel gears is restricted, and vibration at the time of using the chain saw can be restricted, which improves operation feeling.

It is to be noted that a similar effect can be obtained by a configuration in which an elastic member is provided between an end surface of the driving bevel gear 14*a* and a surface of a housing portion for the operating shaft member 14 of the chain cover 5 opposed to the end surface in a state of being compressed in an axial direction of the operating shaft member 14 to provide rotational resistance.

The entire contents of Japanese Patent Application No. 2013-074905 filed on Mar. 29, 2013, on which priority is claimed, are incorporated herein by reference.

While only a select embodiment has been chosen to illustrate and describe the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and it is not for the purpose of limiting the invention, the invention as claimed in the appended claims and their equivalents.

What is claimed is:

1. A chain saw comprising:

a chain tension adjusting apparatus including:

a guide bar in which a saw chain is wound around a circumference of the guide bar, the guide bar including a rotating shaft member, the rotating shaft member being rotatably attached to a side surface of the guide bar, the rotating shaft member including a driven bevel gear connected to a rear end of the rotating shaft member; and an operating shaft member that is axially rotatable to move the guide bar in a longitudinal direction of the chain saw, the operating shaft member including a driving bevel gear connected to an upper end of the operating shaft member, wherein the driving bevel gear of the operating shaft member is meshed with the driven bevel gear of the rotating shaft member, and the operating shaft member is inclined such that the operating shaft member extends outside of a plane, which includes a center axis of the rotating shaft member and extends parallel to the side surface of the guide bar, in a direction obliquely downward and away from the side surface of the guide bar, from the upper end of the operating shaft member, to which the driving bevel gear is connected, to a lower end of the operating shaft member, at which an operating portion of the operating shaft member is disposed.

2. The chain saw according to claim 1, the chain tension adjusting apparatus further including a slide nut, wherein the rotating shaft member is a screw, the rotating shaft member is screwed into the slide nut defining the attachment between side surface of the guide bar and the rotating shaft member, and the operating shaft member is axially rotatable such that the driving bevel gear rotates the driven bevel gear, which in turn rotates the rotating shaft member such that the guide bar is moveable in the longitudinal direction integrally with the slide nut.

3. The chain saw according to claim 2, wherein the operating shaft member is sandwiched and positioned between a chain cover fixed outside a chain saw main body and an operating portion cover removably attached outside the chain cover.

4. The chain saw according to claim 3, wherein the operating portion of the operating shaft member is disposed to project outward from a window opened on the operating portion cover.

5. The chain saw according to claim 2, wherein, around a shaft portion of the operating shaft member, an elastic body is provided in a state of being compressed in a radial direction between the operating shaft member and a member housing the operating shaft member to provide rotational resistance.

6. The chain saw according to claim 5, wherein the elastic body is an O-ring.

7. The chain saw according to claim 2, wherein an elastic body is provided in a state of being compressed in an axial direction between an end surface of the operating shaft member on an opposite side of the operating portion and a surface of a member housing the operating shaft member opposed to the end surface of the operating shaft member to provide rotational resistance.

8. The chain saw according to claim 2, wherein the operating portion of the operating shaft member is a rotating lever having a shape with a non-slip function in an axial rotating direction of the operating shaft member.

9. The chain saw according to claim 8, wherein the shape with the non-slip function in the axial rotating direction is a star shape having a plurality of protrusions axially at regular intervals.

* * * * *